United States Patent [19]

Shizuki et al.

[11] Patent Number: 4,940,560

[45] Date of Patent: Jul. 10, 1990

[54] PROCESS FOR PREPARING ANTISTATIC FIBER

[75] Inventors: Tatsuhiko Shizuki; Kaoru Ban; Fumikazu Yoshida; Masakatsu Ohguchi, all of Otsu, Japan

[73] Assignee: Toyo Boseki Kabushiki Kaisha, Japan

[21] Appl. No.: 186,664

[22] Filed: Apr. 25, 1988

Related U.S. Application Data

[60] Continuation of Ser. No. 853,081, Apr. 17, 1986, abandoned, which is a division of Ser. No. 600,054, Apr. 13, 1984, Pat. No. 4,600,743.

[30] Foreign Application Priority Data

Apr. 14, 1983 [JP] Japan ..... 58-666431
May 9, 1983 [JP] Japan ..... 59-81516

[51] Int. Cl.[5] ..... D01F 1/09; D01F 11/04

[52] U.S. Cl. ..... 264/211; 264/176.1; 264/184; 264/211.14; 264/232; 264/340; 8/115.54

[58] Field of Search ..... 264/211, 211.14, 184, 264/232, 340, 176.1; 524/377; 8/115.54

[56] References Cited

U.S. PATENT DOCUMENTS

| | | | |
|---|---|---|---|
| Re. 28,070 | 7/1974 | Brindell et al. | 524/377 |
| 3,542,904 | 11/1970 | Weitzel et al. | 524/377 |
| 3,917,740 | 11/1975 | Siclari et al. | 524/377 |
| 4,128,614 | 12/1978 | Gilbert | 264/211 |
| 4,229,554 | 10/1980 | Newkirk et al. | 264/211 |
| 4,304,801 | 12/1981 | Newkirk et al. | 264/211 |

FOREIGN PATENT DOCUMENTS 39-5214 3/1964 Japan .

*Primary Examiner*—Hubert C. Lorin
*Attorney, Agent, or Firm*—Jones, Tullar & Cooper

[57] ABSTRACT

An antistatic fiber obtained by melt spinning of a fiber-forming thermoplastic polymer containing at least one of polyoxyalkylene glycol and its derivatives in an amount of not less than 0.5% by weight, characterized in that said fiber has a half life time of electric charge leakage of not more than 150 seconds before and after treatment with a weight decreasing agent and, when treated with a weight decreasing agent, provides a number of streaks arranged in parallel in the lengthwise direction at the surface.

7 Claims, 2 Drawing Sheets

PROCESS FOR PREPARING ANTISTATIC FIBER

Figure 1:
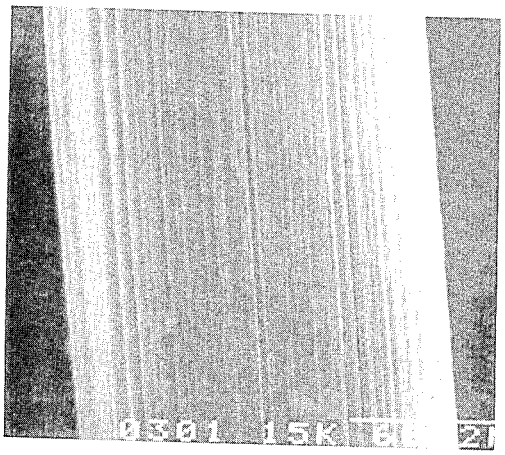

This application is a continuation of application Ser. No. 853,081, filed on Apr. 17, 1986, now abandoned, which is a divisional of application Ser. No. 600,054, filed Apr. 13, 1984, now U.S. Pat. No. 4,600,743.

The present invention relates to an antistatic fiber and its production. More particularly, it relates to a novel thermoplastic synthetic fiber excellent in antistatic level as well as antistatic durability, and its production.

In general, synthetic fibers made of fiber-forming thermoplastic polymers such as polyesters are excellent in mechanical properties. However, those synthetic fibers have remarkably high electric resistance and are apt to be charged with static electricity. In order to prevent such drawbacks, various attempts have been made. For instance, the application of an antistatic agent onto the surface of a synthetic fiber results in elimination of such antistatic agent in the steps for washing, dyeing, etc. so that durable antistatic properties are hardly imparted to the fiber (cf. M. Hayek; Am. Dyest. Reptr., 43, 368 (1954)). Further, for instance, the incorporation of an antistatic agent into a fiber-forming thermoplastic polymer prior to spinning (cf. Japanese Patent Publication (examined) No. 5214/64) requires the use of an antistatic agent in a relatively large amount, by which various excellent mechanical properties are lost. For minimizing the amount of an antistatic agent to be used, the addition of any other component, the utilization of a static mixing element, the adoption of coextrusion spinning process, etc. have been proposed. However, they are not satisfactory in preventing a rise in cost, the instability in working, a variation in quality, etc.

As a result of an extensive study, it has now been found that melt spinning of a fiber-forming thermoplastic polymer containing polyoxyalkylene glycol or its derivative through a spinneret having one or more orifices, each orifice having a certain specific opening area, under a certain specific condition affords a fiber excellent in antistatic properties.

According to the present invention, an antistatic fiber can be prepared by melt spinning a fiber-forming thermoplastic polymer containing at least one of polyoxyalkylene glycol and its derivatives (hereinafter referred to as "POG") in an amount of not less than 0.5% by weight through a spinneret having one or more orifices, each orifice having an opening area of not less than 0.2 $mm^2$, under the condition that the opening area (S; $mm^2$) of each orifice and the throughput (Q; g/min) per orifice satisfies the relationship (1): $S \geqq 0.02\ Q^2+0.2$, preferably the relationship (2): $S \geqq 0.1Q^2+0.2$.

For melt spinning of a fiber-forming thermoplastic polymer, there has heretofore been normally used a spinneret having one or more orifices, each orifice having an opening area of about 0.03 to 0.13 $mm^2$, with a throughput of 0.8 to 3.0 g/min. When melt spinning of a fiber-forming thermoplastic polymer containing POG is effected under such conditions as conventionally adopted, the use of POG in a great amount is essential for attaining satisfactory antistatic properties. Even if a great amount of POG is used, antistatic properties are readily deteriorated with washing treatment; for instance, the half life time for electric charge leakage (determined by the method as hereinafter explained) can not show a value of not more than 150 seconds after washing treatment of 20 times.

Quite surprisingly, melt spinning by the use of a spinneret having one or more orifices, each orifice having an opening area of not less than about 0.2 $mm^2$, under the condition that the opening area of each orifice and the throughput per orifice satisfy said relationship (1), and preferably said relationship (2), provides a fiber excellent in antistatic properties even when the POG content is small. It is well known that the incorporation of POG into a fiber-forming thermoplastic polymer is effective in improvement of antistatic properties. However, it has never been known that the adoption of said spinning conditions makes it possible to obtain a fiber excellent in antistatic properties even when the POG content is small.

The antistatic fiber of the invention prepared as above is characterized in that the filament of said fiber has a half life time of electric charge leakage of not more than 150 seconds before and after and weight decreasing treatment with a weight decreasing agent and, when treated with a weight decreasing agent, provides a number of streaks arranged in parallel in the lengthwise direction at the surface.

Compared with conventional fibers containing POG, the fiber of the invention is markedly improved in antistatic properties such as antistatic level and antistatic durability. It is particularly notable that the antistatic property of the fiber according to the invention is substantially unchanged even after and washing treatment over 20 times or even after a weight decreasing treatment with a weight decreasing agent. While the antistatic level is varied with the POG content and the spinning conditions, the half life time of electric charge leakage of this invention is usually not more than 150 seconds and, when appropriate spinning conditions are chosen, not more than 100 seconds, particularly not more than 50 seconds. Conventional antistatic fibers are extremely inferior in antistatic properties, and their antistatic level and antistatic durability are much decreased after a washing treatment or a weight decreasing treatment with a weight decreasing agent.

While the reason why the fiber of this invention has excellent antistatic properties is still unclarified, it is presumed that the spinning condition, especially the flow state of the fiber-forming thermoplastic polymer containing POG through each orifice of the spinneret, on the manufacture of the fiber may make a great contribution in achievement of said excellent antistatic properties.

Explaining the characteristic structure of the fiber of the invention referring to the accompanying drawings, FIG. 1 is a scanning electron microscopic photograph (×5,000) showing the surface of a filament prepared according to the invention, i.e. by melt spinning a polyester containing POG in an amount of 3% by weight through a spinneret having round orifices, each orifice having an opening area of 0.785 $mm^2$, with a throughput of 0.5 g/min per orifice, stretching the melt spun unoriented polyester filaments by a per se conventional stretching procedure and treating the resulting stretched polyester filaments with an aqueous solution of sodium hydroxide (20 g/liter) at a temperature of 90° to 93° C. to make a decrease of 21% by weight.

Figure 2:
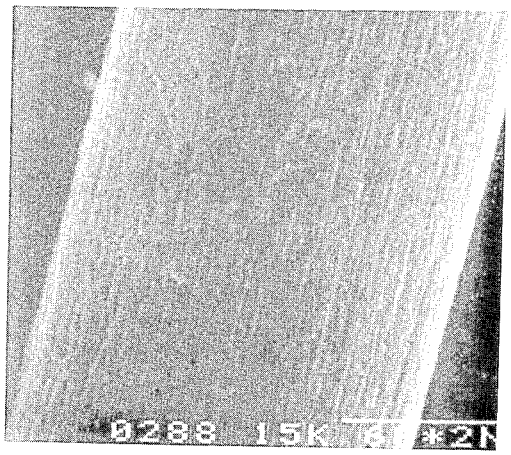

FIG. 2 is a scanning electron microscopic photograph (×5,000) showing the surface of a filament of the fiber prepared by the conventional technique, i.e. by melt spinning a polyester containing POG in an amount of 3% by weight through a spinneret having round orifices, each orifice having an opening area of 0.04

$mm^2$, with a throughput of 0.5 g/min per orifice, stretching the melt spun unoriented polyester filaments by a per se conventional stretching procedure and treating the resulting stretched polyester filaments with an aqueous solution of sodium hydroxide (20 g/liter) at a temperature of 90° to 93° C. to make a decrease of 21% by weight.

Figure 3:
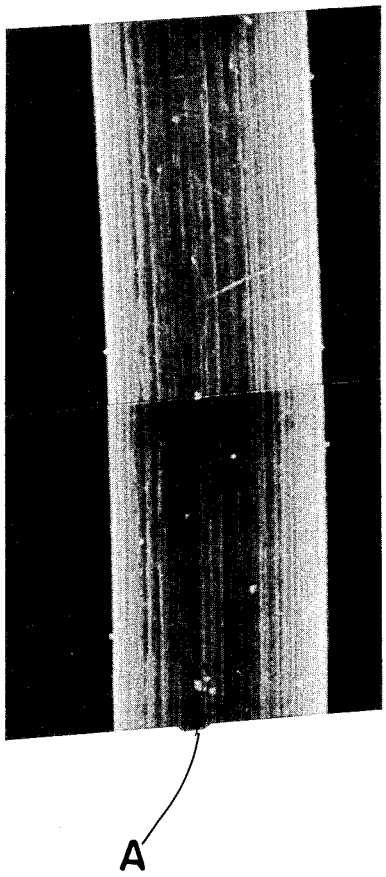
Figure 4:
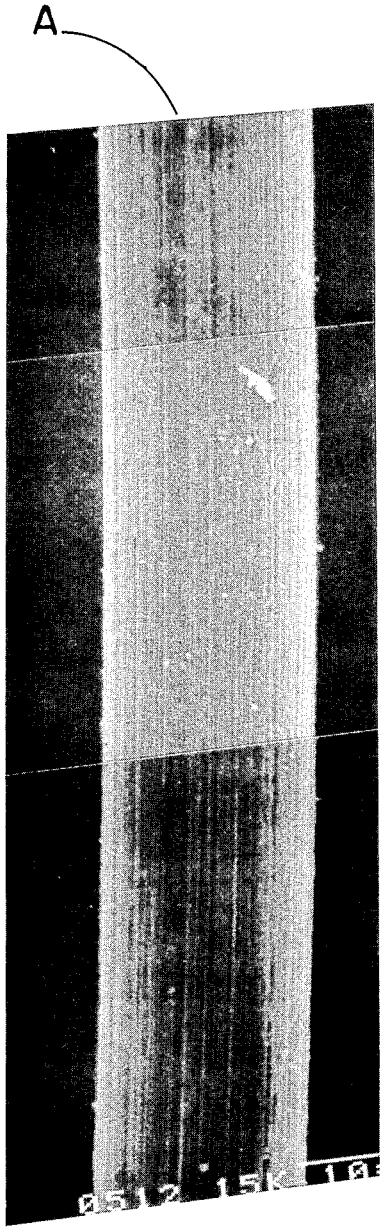

FIG. 3 and FIG. 4 are scanning electron microscopic photographs (×3,000) showing the surface of the same filament as in FIG. 1, the edge A of FIG. 3 (A) is continuous to the edge A of FIG. 4.

The lengthy streaks appearing on the filament of the fiber according to the invention as the result of treatment with an aqueous sodium hydroxide solution as the weight decreasing agent are different from the streaks produced on the filament of the conventional fiber. Namely, the conventional fiber containing POG afford apparently long lines, which are actually formed with overlapped short streaks, on the filament when treated with a weight decreasing agent. To the contrary, the fiber of the invention gives lengthy lines, which are formed as lengthy parallel streaks, on the filament. Thus, in the fiber of the invention, POG is uniformly arranged inside of the filament with such length and width as suitable for leakage of an electric charge, and when treated with a weight decreasing agent, lengthy streaks are produced.

As shown in FIG. 1, the streaks appearing on the surface of the filament of the fiber according to the invention are almost continuous in the lengthwise direction and do not have any end within the field of view. As shown in FIGS. 3 and 4, most of the streaks appearing on treatment with a weight decreasing agent are continuous over the entire length of about 50 microns. The width of each streak is from about 0.05 to 2 microns. At the surface of the filament, streaks of from about 5 to 50 are formed per 10 microns in plane distance towards the outer circumference on the section at right angles to the fiber axis. Not less than ⅓ of the streaks extend continuously through the entire length of about 100 microns in the lengthwise direction. The length of the streaks may be evaluated to be not less than 10–20 folds the diameter of the filament.

In case of conventional fibers, lengthy streaks arranged in parallel are not produced. As shown in FIG. 2, micropores in the state of short solid or dotted lines of several microns or less are produced. Those micropores are entirely different from the lengthy streaks as seen in case of the fiber of the invention. Still, polyester fibers containing no POG do not produce streaks or micropores on the side surface of the filament after treatment with a weight decreasing agent. Accordingly, it may be presumed that the production of streaks or micropores on treatment with a weight decreasing agent is caused by the presence of POG.

From the comparison of FIGS. 1 and 3 and 4 with FIG. 2, it may be understood that POG within the fiber according to the invention is, different from that within the conventional fiber, arranged continuously in the lengthwise direction to form many parallel lines so that the streaks extending in the lengthwise direction and arranged in parallel become appear when treated with a weight decreasing agent.

In the present invention, the surface treating agent may be any one which is conventionally used for the weight decreasing treatment of a fiber so as to improve the texture of the fiber. Such weight decreasing agent dissolves or decomposes a part of the fiber and therefore accompanies the decrease of the weight of the fiber. The weight decreasing agent may be appropriately chosen depending upon the kind of a fiber-forming thermoplastic polymer, of which the fiber is made. When, for instance, the fiber-forming thermoplastic polymer is a polyester, there may be used as the weight decreasing agent an aqueous solution of an alkaline substance (e.g. sodium hydroxide, potassium hydroxide, sodium carbonate, potassium carbonate), an organic solvent (e.g. chlorophenol, nitrobenzene, phenoltetrachloroethane), a solution or dispersion of an organic compound in such organic solvent or the like. When the fiber-forming thermoplastic polymer is a polyamide, the weight decreasing agent may be chosen from sulfuric acid, formic acid, phenol, hot benzyl alcohol, etc., their aqueous solutions, their solutions or dispersions of organic compounds, etc. When the fiber-forming thermoplastic polymer is a polyhydrocarbon such as polypropylene, polyethylene or polystyrene, the weight decreasing agent may be an organic solvent (e.g. toluene, decalin, tetralin) or its solution or dispersion of an organic compound.

The conditions for weight decreasing treatment is varied with the kind and fineness of the fiber, the content of POG in the fiber, the kind of the weight decreasing agent, etc. In general, any condition so as to attain a weight decrease of 5 to 30% by weight may be adopted. For instance, the desired decrease of the polyester can be achieved by treatment with an aqueous sodium hydroxide solution (5 to 50 g/liter) at a temperature of room temperature to 100° C. for a period of 10 to 100 minutes.

The fiber-forming thermoplastic polymer may be any thermoplastic polymer which can be melt spun to form a fiber. Its typical examples are polyesters, polyamides, polyhydrocarbons (e.g. polystyrene, polyethylene, polypropylene), polyetheresters, etc. Among various fiber-forming thermoplastic polymers, particularly suitable are polyesters which comprise the repeating units of the formula:

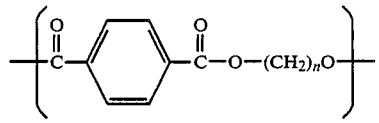

wherein n is an integer of 2 to 6 as the major constituent. Other suitable polymers are polyamides of which typical examples are nylon 6, nylon 66, etc.

Polyesters comprising said repeating units may be polyesters comprising units of terephthalic acid as the major acid component and units of ethylene glycol, tetramethylene glycol, cyclohexane-1,4-dimethanol, etc. as the major glycol component with or without any other optional component(s) in a small amount which does not usually exceed 15 mol %. Examples of the optional component(s) are dicarboxylic acids such as isophthalic acid, adipic acid, sebasic acid and cyclohexane-1,4-dicarboxylic acid, organic sulfonates such as sodium 3,5-di(carbomethoxy)benzenesulfonate, potassium 3,5-di(carbomethoxy)benzenesulfonate, sodium 3,5-di(carboxy)benzenesulfonate, potassium 3,5-di(carboxy)-benzenesulfonate, sodium 3,5-bis(carbo-β-hydroxyethoxy)-benzenesulfonate, sodium 2,5-bis(hydroxyethoxy)benzenesulfonate, potassium 2,5-bis(hydroxyethoxy)benzenesulfonate, potassium 1,8-di(carbomethoxy)naphthalene-3-sulfonate, lithium p-hydroxyethoxybenzenesulfonate, potassium p-hydroxyethoxybenzenesulfonate and sodium p-hydroxybenzenesulfonate, glycols such as neopentyl glycol, 1,6-hexanediol, bisphenol A, polyethylene glycol and a glycol of the formula:

$$HO\text{-}(C_iH_{2i}O)_x\text{-}R\text{-}O\text{-}(C_jH_{2j}O)_y\text{-}H \quad (A)$$

in which R is a divalent aliphatic or aromatic hydrocarbon group having 4 to 20 carbon atoms, i and j are, the same or different, each an integer of 2 to 4, x and y are, the same or different, each an integer satisfying the following equation: $1 \leqq (x+y) \leqq 15$, etc.

When the thermoplastic polymer is a polyester dyeable with a basic dye which comprises at least one ester-forming group and the organic sulfonate as the optional component, there is obtainable a fiber excellent in antistatic properties and wicking property. Particularly when the thermoplastic polymer comprises, as the optional components, units of said glycol (A) in addition to units of the organic sulfonate, the resulting fiber is excellent in affinity to basic dyes and can be dyed even at boiling water temperatures under atmospheric pressure. Favorably, such fiber is also excellent in fastness including light resistance. In the above thermoplastic polymer, the content of units of the organic sulfonate may be usually from 0.5 to 5 mol %, preferably from 1 to 4 mol %. When the content is less than 0.5 mol %, the affinity to basic dyes is insufficient. When the content is more than 5 mol %, the physical properties are much deteriorated.

The POG may be any conventional one which is incorporated into thermoplastic synthetic fibers so as to impart an antistatic property thereto. Specific examples are polyoxyalkylene compounds having hydroxyl groups at both terminal positions such as polyethylene glycol, polypropylene glycol, random or block copolymer of ethylene oxide with propylene oxide, polytetramethylene glycol, block copolymer of polytetramethylene glycol with ethylene oxide added thereto and addition compounds of ethylene oxide to neopentyl glycol or bisphenolic glycols, polyoxyalkylene compounds blocked with intervention of an ether bond(s) at one or both terminal position(s) such as monophenoxypolyethylene glycol, nonylphenoxypolyethylene glycol, sodium sulfophenoxypolyethylene glycol, diphenoxypolyethylene glycol and a compound constituted with two molecules of monophenoxypolyethylene glycol and one molecule of tolylene diisocyanate, polyether compounds esterified at one or both terminal positions such as polyethylene glycol laurate, polyethylene glycol phosphate and its partial alkali salt and polyethylene glycol phosphonate and its partial alkali salt, block copolymer between polyethylene glycol and polyethylene terephthalate, block copolymer between polytetramethylene glycol and polyethylene terephthalate or polybutylene terephthalate, block copolymer between polyethylene glycol and poly-ε-capramide, polyethylene glycol cyanoethylated at one or both terminal positions and its aminated product obtained from the reduction of the cyano group, addition products of ethylene oxide to primary or secondary alkylamines, compounds of the following formulas:

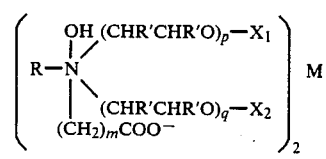

(I)

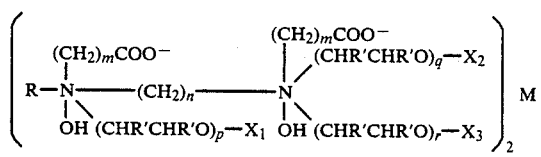

(II)

wherein R is a hydrocarbon atom having 6 to 26 carbon atoms, R′ is a hydrogen atom or a lower alkyl group, each of R′ being same or different, p, q and r are each an integer of 1 to 100, n is an integer of 1 to 4, $X_1$, $X_2$ and $X_3$ are each a hydrogen atom or $-(CH_2)_mCOO^-$, m is an integer of 1 to 3 and M is an alkaline earth metal ion, provided that either one of $X_1$ or $X_2$ is always $-(CH_2)_mCOO^-$.

The polyether compound usable in this invention is not limited to those as exemplified above. Further, they may be used alone or in combination.

When said POG has active hydrogen atom-containing groups such as —OH, —COOH and $-NH_2$ at both terminal positions, its weight average molecular weight (hereinafter referred to as "molecular weight") is preferred to be not less than 6,000. When an active hydrogen atom-containing group is present only at one terminal position and the other terminal position is blocked by any group having no active hydrogen atom, the molecular weight of POG is preferred to be not less than 4,000. When both terminal positions are blocked with groups having no active hydrogen atom, the molecular weight of POG is favorable to be not less than 1,000.

POG may be used as such or in a mixture with any additive such as an oxidation inhibitor, a ultraviolet ray absorber, a pigment or an organic or inorganic ionic compound. For instance, the use of POG in the form of a blend with a vinylic polymer comprising at least one of vinylic unsaturated sulfonic acids and their salts as one of the repeating units is favorable for attaining higher antistatic properties. Examples of vinylic unsaturated sulfonic acids and their salts are unsaturated hydrocarbonsulfonic acids (e.g. styrenesulfonic acid, vinylbenzylsulfonic acid, vinylsulfonic acid, allylsulfonic acid, metallylsulfonic acid) and their salts, acrylic or methacrylic acid sulfoalkyl esters (e.g. acrylic acid sulfoethyl ester, methacrylic acid sulfoethyl ester, acrylic acid sulfopropyl ester, methacrylic acid sulfopropyl ester, acrylic acid sulfobutyl ester, methacrylic acid sulfobutyl ester) and their salts, 2-acrylamido-2-methylpropanesulfonic acid and its salt, etc. Among them, those having an aromatic ring such as styrenesulfonic acid, vinylbenzylsulfonic acid and their salts is favorable. As the salts, there may be exemplified alkali metal salts (e.g. sodium salt, potassium salt, lithium salt), alkaline earth metal salts (e.g. magnesium salt, calcium salt), etc. In general, it is recommended to use the salts rather than the free acids.

Vinylic polymers may be the one obtained by copolymerization of said vinylic unsaturated sulfonic acids or their salts with other polymerizable unsaturated vinyl monomers. Examples of the other polymerizable unsaturated vinyl monomers are conjugated diene monomers (e.g. butadiene, isoprene), aromatic vinyl monomers (e.g. styrene, α-methylstyrene, chlorostyrene), vinylic cyanide monomers (e.g. acrylonitrile, methacrylonitrile), acrylic acid and methacrylic acid and their esters, acrylamide and methacrylamide and their N-alkyl derivatives, halogenated vinyl or vinylidene monomers (e.g. vinyl chloride, vinyl bromide, vinylidene chloride, vinylidene bromide), vinyl ester monomers (e.g. vinyl acetate, vinyl propionate), etc. These may be used alone or in combination.

Said vinylic polymer may be incorporated into the thermoplastic polymer in such an amount that the monomeric units of the vinylic unsaturated sulfonic acid or its salt is about 0.5 to 18% by weight, especially about 0.5 to 15% by weight based on the total weight of POG and the vinylic polymer.

The amount of POG to be incorporated into the thermoplastic polymer according to the invention is not less than 0.5% by weight, preferably not less than 1.0% by weight. When the amount is less than 0.5% by weight, the lengthy streaks arranged in the lengthwise direction do not clearly appear on the treatment with a weight decreasing agent, and the antistatic properties are practically insufficient, the half life time exceeding 150 seconds. Although no exact upper limit is present on the amount of POG, the POG content is preferred to be not more than about 7% by weight, because a higher POG content is apt to deteriorate the fastness to light in dyed fibrous products. Since, however, a higher POG content is favorable for antistatic properties, the actual POG content may be appropriately decided taking into consideration the antistatic property and the light resistance to be realized.

For manufacture of the antistatic fiber of the invention, a fiber-forming thermoplastic polymer containing at least one of POG in an amount of not less than 0.5% by weight is melt spun through a spinneret having one or more orifices, each orifice having an opening area of not less than 0.2 $mm^2$, under the condition that the opening area of each orifice and the throughput per orifice satisfies the relationship (1), preferably the relationship (2).

The addition of POG to the fiber-forming thermoplastic polymer may be carried out at any stage prior to spinning. Thus, the addition may be effected at any stage from the initiation of the polymerization to immediately before spinning insofar as any adverse effect is not produced.

When the fiber-forming thermoplastic polymer is a polyester dyeable with a basic dye, the mixing of the polyester with POG may be accomplished by any of the following procedures: (i) adding a small amount of an organic sulfonate having at least one ester-forming group to the reaction system for production of the polyester by polymerization, effecting the polycondensation up to completion and mixing the thus obtained polyester with POG in a melt state; (ii) adding a small amount of an organic sulfonate having at least one ester-forming group to the reaction system for production of the polyester by polymerization, effecting the polycondensation, introducing POG into the reaction system prior to completion of the polycondensation and completing the polycondensation; and (iii) producing a polyester copolymerized with a large amount of an organic sulfonate having at least one ester-forming group, adding a large amount of POG thereto and mixing the resulting polymer composition with a polyester containing or not small amounts of the organic sulfonate and POG in a melt state.

In this invention, the spinneret is required to have one or more orifices, each orifice having an opening area of not less than 0.2 $mm^2$. Insofar as melt spinning is possible, any upper limitation is not present. From the practical viewpoint, however, a preferred opening area of each orifice is from 0.4 to 1.5 $mm^2$.

Any spinneret for manufacturing the solid fiber may be employed in the invention insofar as the opening area is more than 0.2 $mm^2$, irrespective of its sectional shape such as round shape and non-round shape (e.g. triangle, square, polygon, cross, cross in circle, Y), etc. to which the spinneret of the invention is not, however, limited.

When the melt spinning conditions as in the invention is applied to manufacture of a fiber having a hollow portion (i.e. a hollow fiber), difficulty is observed on spinning stability, and the product excellent in antistatic durability is hardly obtainable with good stability. Accordingly, the process of this invention is not suitable for manufacture of hollow fibers.

The throughput per orifice is not particularly limited and may be appropriately chosen if the quantity can realize the melt spinning and satisfies the relationship (1) or (2). Practically, however, the throughput is inevitably limited depending on the physical property and the producibility of the final product depending upon its purpose and utility and is usually from 0.1 to 5 g/min.

The take up speed of the melt spinning is also not limitative and may be from 500–8000 m/min, preferably from 1,000–4,000 m/min.

The process of the invention may be also accomplished by applying a spinneret for manufacturing mixed yarns. In this instance, the spinneret has one or more orifices, of which each has an opening area of more than 0.2 $mm^2$ per orifice, and at least one orifice which satisfies the requirement (1). Preferably, not less than 5% (particularly not less than 10%) of the orifices in the spinneret satisfy the requirement (1).

The antistatic fiber of the invention may be used as such or may be combined with any other fiber or yarn of different kind to make yarns (e.g. blended woven or knitted yarn, mixed yarn, textured yarn) and fabrics (e.g. blended woven or knitted fabric, non-woven fabric, composite fabric, multi-layered fabric), etc., which also show an excellent antistatic property.

Due to the excellent antistatic performance, the antistatic fiber according to the invention has a great deal of utility, of which typical examples are clothes (e.g. overclothes, underclothes, working garments), lining, domestic goods, bedclothes, interior materials for automobiles (e.g. ceiling and floor material), interior goods for house use, carpets, industrial raw materials, etc, although the utility of the invention is not limited to these examples.

Practical and presently preferred embodiments of the invention are illustratively shown in the following Examples wherein % and part(s) are by weight unless otherwise indicated. Measurements of the physical properties or constants were made in the following manner:

(1) Half life time of electric charge leakage

Measurement of the half life time was made on the knitted product of filaments after refining by a per se conventional procedure according to the method A as defined in JIS (Japanese Industrial Standard) L-1094-

1980 (testing method of antistatic property of a fabricated or knitted product).

For evaluation of the durability in antistatic property, the knitted product after refining was subjected to a washing treatment as explained below and, after drying, measurement of the half life time was made as above.

The washing treatment was carried out by treating the knitted product with an aqueous solution of a synthetic neutral detergent (0.5 g/liter) at 40° C. for 20 minutes by the aid of a washing machine, dehydrating, rinsing with warm water of 40° C. for 5 minutes and dehydrating; these operations were repeated 20 times, followed by drying in the air.

(2) Light resistance

The knitted product of filaments before and after the washing treatment was dyed with a dyeing solution of "Lesolin blue-FBL" (dispersed dye manufactured by Bayer AG) (1.0% owf; bath liquor, 1:50) at 130° C. for 60 minutes, subjected to reduction cleaning and dried in the air. The light resistance of the thus dyed product was measured by the method as defined in JIS L-0842-1971 (testing method of fastness of dyeing against a carbon arc lamp).

(3) Wicking (water absorbing property)

The knitted product of filaments was subjected to measurement of wicking according to the method 6-26-1-(1) A as defined in JIS 1096-1979 (dropping method).

EXAMPLE 1

By a conventional procedure, terephthalic acid and ethylene glycol were subjected to esterification. After initial polycondensation and immediately before completion of the polycondensation, polyethylene glycol (molecular weight, 20,000) admixed with 1,3,5-trimethyl-2,4,6-tris(3,5-di-t-butyl-4-hydroxybenzyl)benzene as an oxidation inhibitor in an amount of 1.0% was added to the reaction mixture so as to make a POG content of 3%, and polycondensation was completed to give a POG-containing polyester having an intrinsic viscosity of 0.635 (determined in a mixture of phenol and tetrachloroethane (6:4) at 30° C.).

Using a spinneret having 36 orifices, each orifice having a round shape and an opening area (S) of 0.785 $mm^2$, the polyester was melt spun at 290° C. with a throughput (Q) of 0.5 g/min per orifice. The spun filaments were cooled and solidified with cooling air of room temperature and taken up at a rate of 1300 m/min. Then, the filaments were stretched with a stretch ratio of 3.5 to give fibers. The fibers were knitted to make a knitted product having a weight of 120 to 190 $g/m^2$. The half life time of electric charge leakage and the light resistance were measured on the knitted product. The results are shown in Table 1, wherein the washing treatment was repeated 20 times and the weight decreasing treatment was carried out under the following conditions: concentration of sodium hydroxide, 20 g/liter; liquor ratio, 1:100; temperature, 90°-93° C.; weight decrease, 21%.

TABLE 1

| | Before washing treatment | | After washing treatment |
|---|---|---|---|
| | Half life time (sec) | Light resistance (grade) | Half life time (sec) |
| Before weight decreasing treatment | 20 | 4–5 | 25 |
| After weight decreasing treatment | 25 | 4–5 | 28 |

The electron microscopic photographs of the surface of the filament obtained in the above Example are shown in FIGS. 1 (×5,000) and 3 (×3,000).

As understood from Table 1, the antistatic polyester fibers obtained in the above Example are small (20 to 28 seconds) in half life time and excellent in antistatic level as well as durability of antistatic property.

As seen in FIGS. 1 and 3 and 4, the fibers after the weight decreasing treatment have many lengthy streaks of not less than 100 microns extended in the lengthwise direction at their surfaces.

Comparative Example 1

Using a spinneret having 36 orifices, each orifice having an opening area of 0.04 $mm^2$, the polyester as obtained in Example 1 was melt spun at 290° C. with a throughput of 0.5 g/min per orifice. The spun filaments were cooled and solidified with cooling air of room temperature and taken up at a speed of 1300 m/min. Then, the filaments were stretched with a stretch ratio of 3.5 to give fibers. In the same manner as in Example 1, the fibers were knitted to make a knitted product. The half life time of electric charge leakage and the light resistance were measured on the knitted product. The results are shown in Table 2, wherein the washing treatment as well as the weight decreasing treatment was carried out as in Example 1.

TABLE 2

| | Before washing treatment | | After washing treatment |
|---|---|---|---|
| | Half life time (sec) | Light resistance (grade) | Half life time (sec) |
| Before weight decreasing treatment | 300< | 4–5 | 300< |
| After weight decreasing treatment | 300< | 4–5 | 300< |

The electron microscopic photograph of the surface of the filament obtained in the above Comparative Example is shown in FIG. 2 (×5,000).

As understood from Table 2, the antistatic polyester fibers obtained in the above Comparative Example (i.e. according to the conventional technique) are much inferior to the antistatic polyester fibers obtained in Example 1 (i.e. according to the invention) in antistatic level as well as durability of antistatic property.

As seen in FIG. 2, the fibers after weight decreasing treatment have many micropores of several microns in length at random.

Comparative Example 2

Using a spinneret having 36 orifices, each orifice having a round shape and an opening area of 0.04 $mm^2$, the polyester as obtained in Example 1 but increasing the POG content to 7% was melt spun at 290° C. with a throughput of 0.5 g/min per orifice. The spun filaments were cooled and solidified with cooling air of room temperature and taken up at a speed of 1300 m/min. Then, the filaments were stretched with a stretch ratio of 3.5 to give fibers. In the same manner as in Example 1, the fibers were knitted to make a knitted product. The half life time of electric charge leakage and the light resistance were measured on the knitted product. The results are shown in Table 3, wherein the washing treatment as well as the weight decreasing treatment was carried out as in Example 1.

TABLE 3

| | Before washing treatment | | After washing treatment |
|---|---|---|---|
| | Half life time (sec) | Light resistance (grade) | Half life time (sec) |
| Before weight decreasing treatment | 250 | 3 | 300< |
| After weight decreasing treatment | 300< | 3 | 300< |

As understood from Table 3, the antistatic polyester fibers obtained in the above Comparative Example (i.e. according to the conventional technique) are much inferior to the antistatic polyester fibers obtained in Example 1 (i.e. according to the invention) in antistatic level. The half life time is also much deteriorated.

EXAMPLE 2

Chips of nylon 6 having a relative viscosity of 2.5 (determined in 1.0 g/dl conc. sulfuric acid solution at 20° C.) were dried. To 100 parts of the dried chips, polyethylene glycol (molecular weight, 20,000) (2.04 parts) and 1,3,5-trimethyl-2,4,6-tris(3,5-di-t-butyl-4-hydroxybenzyl)-benzene (0.02 part) were added, followed by mixing.

Using a spinneret having 24 orifices, each orifice having a round shape and an opening area of 0.785 $mm^2$, the above mixture was melt spun at 260° C. with a throughput of 0.94 g/min per orifice. The spun filaments were cooled and solidified with cooling air of room temperature and taken up at a speed of 900 m/min. Then, the filaments were stretched by a conventional procedure to give long fibers of 70 denier/24 filaments. The long fibers were knitted to make a knitted product having a weight of 140 $g/m^2$. The half life time of electric charge leakage was measured on the knitted product. The results are shown in Table 4, wherein the washing treatment was repeated 20 times and the weight decreasing treatment was carried out using aqueous formic acid solution with a weight decrease of 7%.

TABLE 4

| | Before washing treatment Half life time (sec) | After washing treatment Half life time (sec) |
|---|---|---|
| Before weight decreasing treatment | 30 | 38 |
| After weight decreasing treatment | 40 | 46 |

As understood from Table 4, the antistatic nylon fibers obtained in the above Example are small (30 to 46 seconds) in half life time and excellent in antistatic level as well as durability of antistatic property.

At the side surface of the filament after weight decreasing treatment, many lengthy streaks arranged in the lengthwise direction were observed. The streaks were extended substantially over the entire length of 50 microns.

Comparative Example 3

In the same manner as in Example 2 but using a spinneret having 24 orifices, each orifice having a round shape and an opening area of 0.0615 $mm^2$, the nylon 6 mixture was melt spun, stretched and knitted. The half life time of electric charge leakage was measured on the knitted product. The results are shown in Table 5, wherein the washing treatment as well as the weight decreasing treatment was carried out as in Example 2.

TABLE 5

| | Before washing treatment Half life time (sec) | After washing treatment Half life time (sec) |
|---|---|---|
| Before weight decreasing treatment | 100 | 180< |
| After weight decreasing treatment | 180< | 180< |

As understood from Table 5, the antistatic nylon 6 fibers obtained in the above Comparative Example (i.e. according to the conventional technique) are much inferior to the antistatic nylon 6 fibers obtained in Example 2 (i.e. according to the invention) in antistatic level as well as durability of antistatic property.

At the surfaces of the filaments after weight decreasing treatment, lengthy streaks arranged in the lengthwise direction were not observed.

EXAMPLE 3

By a conventional procedure, terephthalic acid and ethylene glycol were subjected to esterification. After initial polycondensation and immediately before completion of the polycondensation, polyethylene glycol (molecular weight, 20,000) admixed with 1,3,5-trimethyl-2,4,6-tris(3,5-di-t-butyl-4-hydroxybenzyl)benzene in an amount of 1.0% was added to the reaction mixture so as to make a POG content as indicated in Table 6, and polycondensation was completed to give a POG-containing polyester having an intrinsic viscosity as indicated in Table 6 (determined in a mixture of phenol and tetrachloroethane (6:4) at 30° C.).

Under the conditions as shown in Table 6 using a spinneret having 36 orifices, each orifice having a round shape, the polyester was melt spun at 290° C. The spun filaments were cooled and solidified and taken up at a speed of 1300 m/min (600 m/min in Run No. 21). Then, the filaments were stretched, and the resulting fibers were knitted to make a knitted product. The half life time of electric charge leakage and the light resistance were measured on the knitted product. The results are shown in Table 6, wherein the washing treatment was repeated 20 times.

TABLE 6

| Run No. | POG content (%) | S ($mm^2$) | Q (g/min) | Intrinsic viscostiy ($\eta$) | Before washing treatment: Half life time (sec) | Before washing treatment: Light resistance (grade) | After washing treatment: Half life time (sec) | After washing treatment: Light resistant (grade) |
|---|---|---|---|---|---|---|---|---|
| 1 | 0.25 | 0.04 | 1.0 | 0.640 | 300< | 5< | 300< | 5< |
| 2 | 0.25 | 0.785 | 1.0 | 0.640 | 300< | 5< | 300< | 5< |
| 3 | 0.5 | 0.04 | 1.0 | 0.642 | 300< | 5 | 300< | 5 |
| 4 | 0.5 | 0.785 | 1.0 | 0.642 | 150 | 5 | 150 | 5 |
| 5 | 7.0 | 0.126 | 1.0 | 0.652 | 180 | 3 | 250 | 3 |
| 6 | 7.0 | 0.625 | 1.0 | 0.652 | 2 | 3 | 10 | 3 |
| 7 | 8.0 | 0.126 | 1.0 | 0.648 | 150 | 2 | 220 | 2 |
| 8 | 8.0 | 0.625 | 1.0 | 0.648 | 2 | 2 | 8 | 2 |
| 9 | 3.0 | 0.04 | 0.5 | 0.635 | 300< | 4–5 | 300< | 4–5 |
| 10 | 3.0 | 0.04 | 1.0 | 0.635 | 300< | 4–5 | 300< | 4–5 |
| 11 | 3.0 | 0.30 | 1.0 | 0.635 | 100 | 4–5 | 105 | 4–5 |
| 12 | 3.0 | 0.30 | 0.5 | 0.635 | 65 | 4–5 | 70 | 5 |
| 13 | 3.0 | 0.785 | 0.5 | 0.635 | 20 | 4–5 | 25 | 4–5 |
| 14 | 3.0 | 0.785 | 1.0 | 0.635 | 25 | 4–5 | 28 | 5 |
| 15 | 4.0 | 0.196 | 0.5 | 0.630 | 220 | 4 | 210 | 4 |
| 16 | 4.0 | 0.196 | 1.0 | 0.630 | 240 | 4 | 220 | 4 |
| 17 | 4.0 | 0.50 | 0.5 | 0.630 | 15 | 4 | 18 | 4 |
| 18 | 4.0 | 0.50 | 1.0 | 0.630 | 18 | 4 | 18 | 4 |
| 19 | 4.0 | 0.785 | 3.0 | 0.630 | 140 | 4 | 130 | 4 |
| 20 | 4.0 | 0.785 | 1.6 | 0.630 | 50 | 4 | 45 | 4 |
| 21 | 4.0 | 0.785 | 0.4 | 0.630 | 10 | 4 | 12 | 4 |

From Table 6, it is understood that the fibers manufactured from the polyester containing POG in a content of 0.3% are inferior in antistatic properties (Run Nos. 1 and 2; for comparison), while the fibers manufactured from the polyester containing POG in a content of 8% are very excellent in antistatic properties although the light resistance is somewhat inferior (Run No. 8; according to the invention). Compared with the fibers containing POG in 8% (Run No. 7; for comparison), the fibers containing POG in 0.5% (Run No. 4; according to the invention) have excellent antistatic properties without deterioration of light resistance in spite of a smaller POG content.

The fibers manufactured by melt spinning the polyester containing POG in 3.0% through a spinneret (each orifice having an opening area of not less than 0.2 $mm^2$) under the condition satisfying the requirement (1) or (2) (Run Nos. 11 to 14; according to the invention) show much better antistatic properties than the corresponding comparative cases (Run Nos. 9 and 10; for comparison).

When the fibers are manufactured from the polyester containing POG in 4.0%, those according to the invention (Run Nos. 17 to 21) are much better than those for comparison (Run Nos. 15 and 16) in antistatic properties.

Still, Run No. 6 is an embodiment of the invention while Run Nos. 3 and 5 are for comparison.

EXAMPLE 4

Styrene (40 parts), sodium p-styrenesulfonate (50 parts) and methyl methacrylate (10 parts) were subjected to polymerization in an aqueous medium containing a Redox catalyst (ammonium persulfate-sodium acidic sulfite) to produce a vinylic polymer (a). The resulting emulsion containing the vinylic polymer (a) was neutralized, polyoxyethylene glycol (b) having an molecular weight of 20,000 was dissolved therein, and water was removed at 80° C. under reduced pressure to give a resinous product (c) having the (a)/(b) ratio=1/9.

By a conventional procedure, terephthalic acid and ethylene glycol were subjected to esterification. After initial polycondensation and immediately before completion of the polycondensation, the above obtained resinous product (c) was added to the reaction mixture in an amount of 3.33% (corresponding to a POG content of 3%), and polycondensation was completed while stirring.

The thus produced polyester was discharged from the reactor and cut to give chips having an intrinsic viscosity of 0.634. In the same manner as in Run No. 12 of Example 3, the chips were subjected to melt spinning and stretching. The thus prepared fibers were knitted to make a knitted product. The half life time of electric charge leakage and the light resistance were measured on the knitted product. The results are shown in Table 7, wherein the washing treatment was repeated 20 times.

TABLE 7

| Before washing treatment: Half life time (sec) | Before washing treatment: Light resistance (grade) | After washing treatment: Half life time (sec) | After washing treatment: Light resistance (grade) |
|---|---|---|---|
| 28 | 4–5 | 31 | 5 |

As understood from Table 7, the fibers manufactured from the polyester incorporated with POG containing a small amount of a vinylic polymer as in the above Example are much more excellent than those manufactured from the polyester containing POG in 3% as in Run No. 12 of Example 3 in antistatic properties.

EXAMPLE 5

Into a reactor, dimethyl terephthalate, ethylene glycol and a catalyst were charged, and sodium 3,5-di(carbomethoxy)benzenesulfonate (hereinafter referred to as "DSN") was added therein in an amount of 2.3 mol % to the total acid components. By a conventional procedure, ester exchange and polycondensation were carried out to make a polyester having an intrinsic viscosity of 0.41.

The polyester and polyethylene glycol having a molecular weight of 20,000 previously incorporated with titanium dioxide in an amount of 0.05% were sent to an extruder to make a predetermined POG content and melt spun through a spinneret of round or Y shape (24 orifices) with a throughput of 24 g/min, followed by taking up at a speed of 900 to 1300 m/min. The resulting filaments were stretched by a conventional procedure to give fibers of 50 d/24 f. The resulting fibers were knitted to make a knitted product having a weight of 150 g/m$^2$. The half life time of electric charge leakage and the wicking were measured on the knitted product. The results are shown in Table 8.

TABLE 8

| Run No. | Spinneret Shape | Spinneret Opening area (mm$^2$) | POG content (%) | Wicking (sec) Washing 1 time | Wicking (sec) Washing 20 times | Half life time (sec) Washing 1 time | Half life time (sec) Washing 20 times | Remarks |
|---|---|---|---|---|---|---|---|---|
| 22 | round | 0.04 | 4 | 100 | 180< | 180< | 180< | |
| 23 | Y | 0.04 | 5 | 60 | 150 | 180< | 180< | |
| 24 | round | 0.04 | 6 | 30 | 140 | 120 | 180< | |
| 25 | round | 0.04 | 8 | 20 | 100 | 100 | 120 | Spinnability lowered |
| 26 | round | 0.04 | 10 | 10 | 20 | 40 | 60 | Spinnability lowered |
| 27 | round | 0.19 | 3 | 50 | 140 | 150 | 180< | |
| 28 | round | 0.25 | 3 | 20 | 30 | 70 | 80 | |
| 29 | round | 0.45 | 3 | 5 | 5 | 30 | 30 | |
| 30 | round | 0.785 | 3 | 1 | 1 | 16 | 16 | |
| 31 | Y | 0.41 | 3 | 1 | 1 | 26 | 26 | |
| 32 | Y | 0.80 | 0.5 | 20 | 20 | 50 | 50 | |
| 33 | Y | 0.80 | 3 | 1 | 1 | 15 | 15 | |

As understood from Table 8, the fibers for comparison (Run Nos. 22 to 26) are somewhat satisfactory in antistatic property and wicking property when the POG content is so large as 10% but the spinninability is lowered to cause breakage of filaments and fluffing in filaments, which lead to depression in workability of spinning and stretching. In Run No. 27 for comparison, spinning was carried out by the use of a spinneret having a round orifice of 0.19 mm$^2$ in opening area, and the obtained fibers containing POG in 3% were still insufficient in antistatic property and wicking property.

The fibers obtained by spinning through a spinneret having an orifice of not less than 0.2 mm$^2$ in opening area according to the invention (Run Nos. 28 to 33) show excellent durable antistatic property and wicking property in a small POG content. It is especially notable that the fibers in Run No. 32 contain POG only in 0.5% yet show such high antistatic property and wicking property as practically acceptable.

From the above results, it may be understood that the opening area of each orifice in a spinneret makes a great contribution to improvement of antistatic property and wicking property.

EXAMPLE 6

By a conventional procedure, terephthalic acid and ethylene glycol were subjected to esterification and polycondensation. Immediately before completion of the polycondensation, polyethylene glycol (molecular weight, 20,000) admixed with 1,3,5-trimethyl-2,4,6-tris(3,5-di-t-butyl-4-hydroxybenzyl)benzene as an oxidation inhibitor in an amount of 2% was added to the reaction mixture, and polycondensation was completed to give a POG-containing polyester.

Separately, dimethyl terephthalate and ethylene glycol were subjected to esterification and polycondensation in the presence of DSN as an acid component to give a DSN-containing polyester.

Appropriate amounts of the POG-containing polyester and the DSN-containing polyester were melted separately and mixed together. As in Example 5, the resultant mixture was subjected to spinning and stretching. In the same manner as in Example 5, the antistatic property and the wicking property were measured. The results are shown in Table 9.

TABLE 9

| Run No. | DSN content in total acid component (mol %) | POG content in fibers (%) | Spinneret Shape | Spinneret Opening area (mm$^2$) | Wicking (sec) Washing 1 time | Wicking (sec) Washing 20 times | Half life time (sec) Washing 1 time | Half life time (sec) Washing 20 times |
|---|---|---|---|---|---|---|---|---|
| 34 | 0 | 3 | round | 0.04 | 40 | 180< | 180< | 180< |
| 35 | 0 | 5 | round | 0.04 | 20 | 180< | 180< | 180< |
| 36 | 0 | 3 | round | 0.785 | 30 | 180< | 25 | 28 |
| 37 | 0 | 5 | round | 0.785 | 10 | 180< | 20 | 20 |
| 38 | 1.5 | 3 | Y | 0.785 | 2 | 3 | 25 | 25 |
| 39 | 2.3 | 3 | Y | 0.785 | 1 | 1 | 16 | 15 |
| 40 | 3.0 | 3 | Y | 0.785 | 1 | 1 | 12 | 12 |
| 41 | 3.0 | 2 | Y | 0.08 | 140 | 180< | 180< | 180< |
| 42 | 3.0 | 2 | Y | 0.41 | 2 | 2 | 25 | 25 |
| 43 | 3.0 | 2 | Y | 0.785 | 1 | 1 | 8 | 8 |

As understood from Table 9, the fibers in Run Nos. 34 to 37 for comparison have substantially no affinity to basic dyes. In Run Nos. 36 and 37, the fibers show an excellent antistatic property. They have wicking property at the initial stage but lose such property after washing treatment of 20 times.

In Run Nos. 38 to 40 as embodiments of the invention, the fibers are dyeable with basic dyes and excellent in antistatic property and wicking property. In addition, their durability is quite satisfactory.

In Run No. 41 for comparison, the opening area of the orifice is small, and the fibers are insufficient in antistatic property and wicking property. In Run Nos. 42 and 43 as embodiments of the invention, the fibers are dyeable with basic dyes and excellent in antistatic property and wicking property.

What is claimed is:

1. A process for preparing an antistatic fiber, comprising the steps of:

providing a spinneret having one or more orifices, each orifice having an opening area of not less than 0.2 $mm^2$; and melt spinning a fiber forming thermoplastic polymer containing at least one of polyoxyalkylene glycol and its derivatives as an amount of not less than 0.5% by weight through the spinneret, under the conditions that the opening area (S; $mm^2$) of each orifice and the throughput (Q; g/mm) per orifice satisfies the following relationship: $S \geqq 0.02Q^2+0.2$, and such that the fibers formed have a half-life time of electric charge leakage of not more than 150 seconds before and after treatment with a weight decreasing agent.

2. The process according to claim 1, wherein the thermoplastic polymer comprises a polyester.

3. The process according to claim 2, wherein the polyester comprises units of an organic sulfonate having at least one ester-forming group.

4. The process according to claim 3, wherein the organic sulfonate is sodium 3,5-di(carbomethoxy)benzenesulfonate.

5. The process according to claim 3, wherein the polyester comprises as one of the repeating units a glycol of the formula:

$$HO\text{-}(C_iH_{2i}O)_x\text{-}R\text{-}O\text{-}(C_jH_{2j}O)_y\text{-}H$$

in which R is a divalent aliphatic or aromatic hydrocarbon group having 4 to 20 carbon atoms, i and j are each an integer of 2 to 4, x and y are each an integer satisfying the following relationship: $1 \leqq (x+y) \leqq 15$.

6. The process according to claim 1, wherein the thermoplastic polymer comprises a polyester and a vinylic polymer comprising as one of the repeating units a vinylic sulfonic acid or its salt.

7. The process according to claim 1, wherein the thermoplastic polymer comprises a polyamide.

* * * * *